US007530827B2

(12) United States Patent
Caveney et al.

(10) Patent No.: US 7,530,827 B2
(45) Date of Patent: May 12, 2009

(54) RACEWAY IDC CONNECTOR

(75) Inventors: Jack E. Caveney, Hinsdale, IL (US); Shaun P. Brouwer, St. John, IN (US); Dale A. Block, Schererville, IN (US)

(73) Assignee: Penduit Corp., Tinley Park, IL (US)

( * ) Notice: Subject to any disclaimer, the term of this patent is extended or adjusted under 35 U.S.C. 154(b) by 0 days.

(21) Appl. No.: 12/124,669

(22) Filed: May 21, 2008

(65) Prior Publication Data

US 2008/0293288 A1 Nov. 27, 2008

Related U.S. Application Data

(60) Provisional application No. 60/939,425, filed on May 22, 2007.

(51) Int. Cl.
*H01R 4/60* (2006.01)

(52) U.S. Cl. ..... 439/211; 439/404

(58) Field of Classification Search ..... 439/209, 439/211, 395, 404, 405, 402, 403
See application file for complete search history.

(56) References Cited

U.S. PATENT DOCUMENTS

| | | | | |
|---|---|---|---|---|
| 3,189,863 | A | 6/1965 | Leach | |
| 3,868,161 | A * | 2/1975 | Frantz | 439/107 |
| 4,243,286 | A | 1/1981 | Brown et al. | |
| 4,245,880 | A * | 1/1981 | Zimmerman et al. | 439/405 |
| 4,284,316 | A | 8/1981 | Debaigt | |
| 4,491,379 | A | 1/1985 | Brown et al. | |
| 4,552,429 | A | 11/1985 | Van Alst | |
| 4,872,849 | A * | 10/1989 | Long | 439/209 |
| 4,929,190 | A | 5/1990 | Gonon et al. | |
| 5,022,868 | A | 6/1991 | Legrady | |
| 5,080,606 | A | 1/1992 | Burkard | |
| 5,207,587 | A | 5/1993 | Hamill et al. | |
| 5,251,092 | A | 10/1993 | Brady et al. | |
| 5,338,220 | A | 8/1994 | Soes et al. | |
| 5,498,172 | A * | 3/1996 | Noda | 439/404 |
| 5,567,173 | A * | 10/1996 | Franckx | 439/418 |
| 5,681,181 | A | 10/1997 | Atsumi | |
| 5,683,268 | A * | 11/1997 | Drach et al. | 439/404 |
| 5,964,620 | A | 10/1999 | Takahashi et al. | |
| 5,980,303 | A | 11/1999 | Lee et al. | |
| 6,056,584 | A | 5/2000 | Daoud | |

(Continued)

FOREIGN PATENT DOCUMENTS

DE 2360775 A1 6/1975

(Continued)

*Primary Examiner*—Neil Abrams
*Assistant Examiner*—Phuong Nguyen
(74) *Attorney, Agent, or Firm*—Robert A. McCann; Christopher S. Clancy

(57) ABSTRACT

A dual-sided IDC connector for use in connecting electrical components to field wiring is described. One side of the IDC connector may be factory-wired to an electrical component. A second side of the IDC connector may be field-wired in an end-wiring or a through-wiring configuration. The second side of the IDC connector may have multiple covers to minimize the effort required by a field technician to terminate the field-wiring. The IDC connector may be easily mounted to existing raceways, outlet strips, and junction boxes.

20 Claims, 16 Drawing Sheets

U.S. PATENT DOCUMENTS

| | | | |
|---|---|---|---|
| 6,113,421 | A | 9/2000 | Daoud |
| 6,123,566 | A | 9/2000 | Daoud et al. |
| 6,142,817 | A | 11/2000 | Lee |
| 6,152,759 | A | 11/2000 | Daoud et al. |
| 6,247,960 | B1 | 6/2001 | Daoud |
| 6,261,118 | B1 | 7/2001 | Daoud |
| 6,312,282 | B1 | 11/2001 | Blaha et al. |
| 6,315,599 | B1 | 11/2001 | Daoud |
| 6,328,592 | B1 | 12/2001 | Burke et al. |
| 6,398,571 | B1 | 6/2002 | Nishide et al. |
| 6,494,750 | B2 | 12/2002 | Morita et al. |
| 6,866,536 | B1 | 3/2005 | Lee |
| 7,156,686 | B1 | 1/2007 | Sekela et al. |

FOREIGN PATENT DOCUMENTS

| | | | |
|---|---|---|---|
| WO | 9409533 | A | 4/1994 |

* cited by examiner

RACEWAY IDC CONNECTOR

CROSS REFERENCE TO RELATED APPLICATION

This application claims priority from U.S. Provisional Patent Application No. 60/939,425, filed May 22, 2007, the entire disclosure of which is hereby incorporated by reference.

FIELD OF THE INVENTION

The present invention relates generally to electrical connectors and, more particularly, to a dual-sided insulation displacement contact ("IDC") connector for use in field-wiring and factory-wiring, capable of being installed in a raceway, outlet strip, and other electrical field installations.

BACKGROUND OF THE INVENTION

Electrical connectors are used to connect many types of insulated wires, and enable technicians to connect insulated wires without having to strip and crimp the wires. Typically, an IDC connector may be a housing with channels for wires to pass through, a cover, and one or more IDC's. IDC's comprise an electrically conductive material, and may have a "U" shape on one or more sides. IDC's may pierce through the wire insulation when a force is applied between the wire and the IDC. After the IDC pierces the wire insulation of a first wire, the IDC contact may make electrical contact with the first wire. The opposite end of the IDC from the end in contact with the first wire may be positioned around or along a second wire, and force may be applied between the second wire and the IDC. The IDC may pierce the insulation of the second wire, and electrical contact may be made between the first and second wires through the IDC.

One problem that exists when terminating wires using an IDC connector is that a great deal of force may be required for the field technician to properly push down the cover onto the connector and thereby terminate the connections. Pushing down on a cover of an IDC connector may create the force between the wire and the IDC contact needed for the IDC to pierce the wire insulation. However, the force required to pierce the wire insulation may be large, so that it is uncomfortable or inconvenient for the field technician to terminate the contacts.

An additional problem is that, typically, the field technician must install a connector on each side that is to be terminated. For instance, a first wire or set of wires may be installed into one side of the housing corresponding to one end of one or more IDC's, and a second wire or set of wires may be installed into a second side of the housing corresponding to the opposite end of one or more IDC's. This takes time and, as previously stated, may require a great deal of physical effort on the part of the technician to properly terminate the wires.

Another problem is that alter terminating the IDC, it may be desirable to place the connector in a field configuration, i.e., on a raceway, in an electrical box, in an outlet strip, or another configuration. Connectors that are not adapted to be easily installed in such field configurations may require extra time from the field technician to complete the installation.

SUMMARY OF THE INVENTION

A dual-sided IDC connector for use in connecting electrical components to field wiring is described. One side of the IDC connector may have wires from an electrical component that are terminated and installed in the factory. A second side of the IDC connector may be field-wired in an end-wiring or a through-wiring configuration.

Terminating the electrical component wiring to the IDC connector in the factory or at a time before field installation of the electrical component may reduce the time and labor necessary to install and terminate IDC connectors. Because the factory wiring may be already installed in a first side of the IDC connector, the field technician may only need to install the field wiring in a second side of the IDC connector.

The IDC connector may be easily mounted to existing raceways, outlet strips, and junction boxes. This may increase efficiency, as less time is required to install the connectors after the wiring has been terminated.

DETAILED DESCRIPTION OF THE PREFERRED EMBODIMENTS

Figure 1:
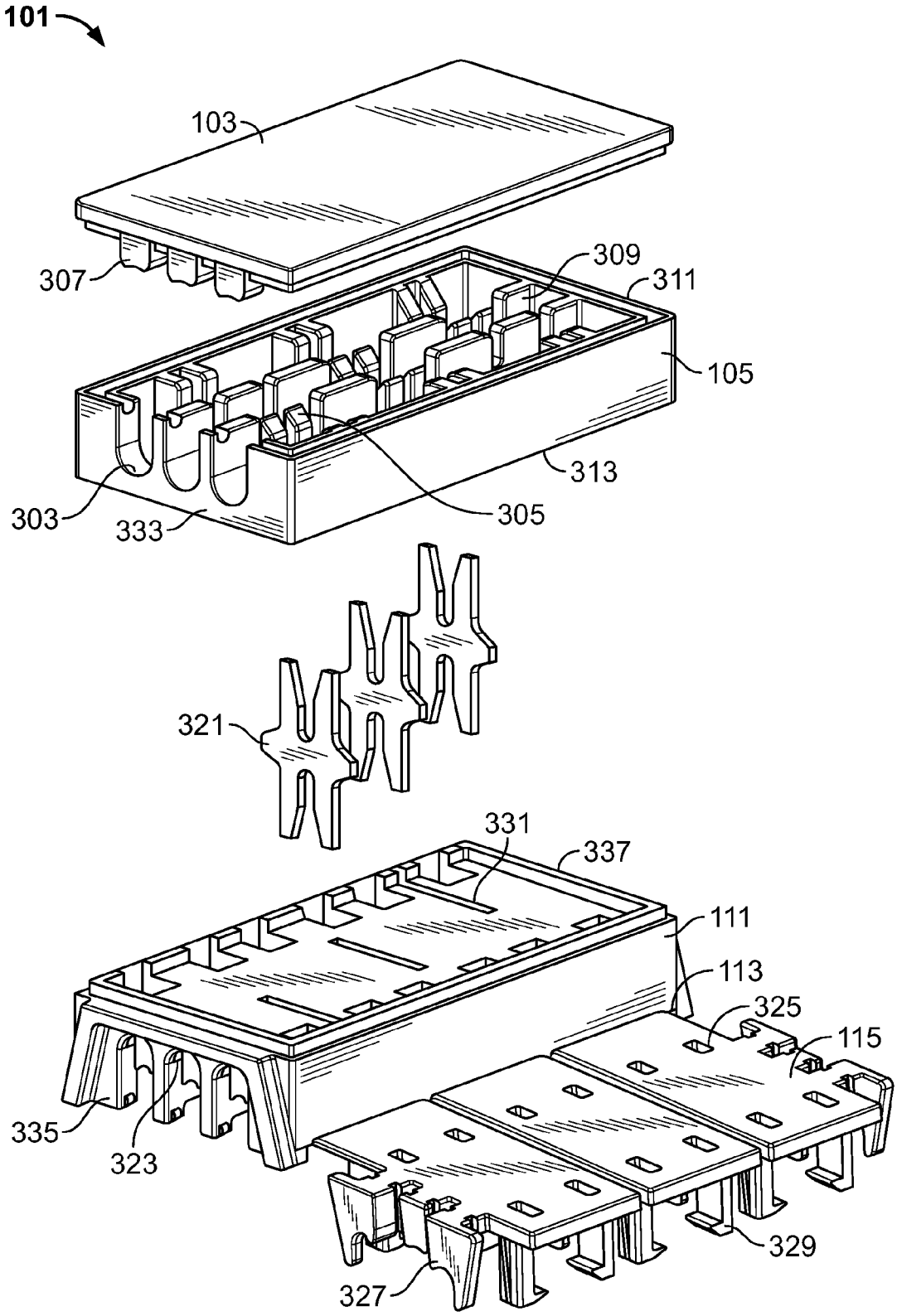
FIG. 1 is a front upper right exploded view of an IDC connector, in accordance with an embodiment of the present invention.

FIG. 1 is a front upper right expanded view of an insulation displacement contact ("IDC") connector 101. The IDC connector 101 has a factory housing 105, a factory cover 103, a field housing 111, field covers 115, and IDC's 321.

The factory housing 105 may have two side walls, a front wall 333, and an end wall 311. One or more factory wire apertures 303 may be located on the front wall 333 and the end wall 311 of the factory housing 105.

The factory housing 105 is shown in FIGS. 1-13*d* as having factory wire apertures 303 only on the front wall 333. Frequently, wires from electrical components may be installed into an IDC connector in an end-wiring configuration. In this case, it may be desirable to have a solid end wall 311, as shown in FIGS. 1-13*d*.

Alternatively, factory wire apertures 303 may be located on the end wall as shown with respect to the front wall 333. Wiring from the electrical component may be installed in a through-wiring configuration, and the wires may pass through the factory wire apertures 303 on the front wall 333 and the end wall 311.

The factory wire apertures 303 hold the factory-installed wiring as it enters the factory housing 105. Factory guide walls 309 are located inside the factory housing 105. The factory guide walls 309 are shown in FIG. 1 as being interrupted by the factory IDC guides 305. The number and location of the interruptions in the length of the factory guide walls 309 may depend on the number, size, and location of IDC's 321 and the IDC apertures 313. The factory guide walls 309 may be parallel to the side walls of factory housing 105. The factory guide walls 309 may separate and guide the factory-installed wiring to the desired position. IDC apertures 313 may be located on the bottom surface of the factory housing 105, and may allow the IDC's 321 to pass through the bottom surface of the factory housing 105 in order to make electrical contact with the factory wiring.

Factory IDC guides 305 are located inside the factory housing 105 over the IDC apertures 313. The factory IDC guides 305 may guide the IDC's 321 into position and may prevent the IDC 321 from bending in response to forces exerted on the IDC 321 from the wiring as the IDC 321 pierces the wire insulation to make contact with the wire. The IDC apertures 313 and factory IDC guides 305 are preferably staggered to allow the IDC connector 101 to be narrower. FIG. 1 shows the IDC's 305 staggered so that the IDC's 321 progressively move from left to right in a direction away from the front wall 333. However, the IDC's 305 may be located in any configuration. Additionally, FIG. 1 shows an IDC connector 101 with positions for three wires; however, any number of wires and IDC's 321 may be used.

A factory cover 103 may be sized to fit over the factory housing 105. The factory cover 103 may have factory cover wire restraints 307 positioned to align with the factory wire apertures 303. The factory cover wire restraints 307 may prevent the factory wiring from moving away from the factor wire apertures 303 when the factory cover 103 is installed.

The field housing 111 has two side walls, a front wall 335, and a back wall 337. One or more field wire apertures 323 may be located on the front wall 335 and the back wall 337 of the field housing 111. Field wiring may commonly be installed in an end-wiring or in a through-wiring configuration. One or more field wire apertures 323 may be located on the front wall 335 and back wall 337. The field wire apertures 323 may hold the factory-installed wiring as it enters the field housing 111.

Figure 4:
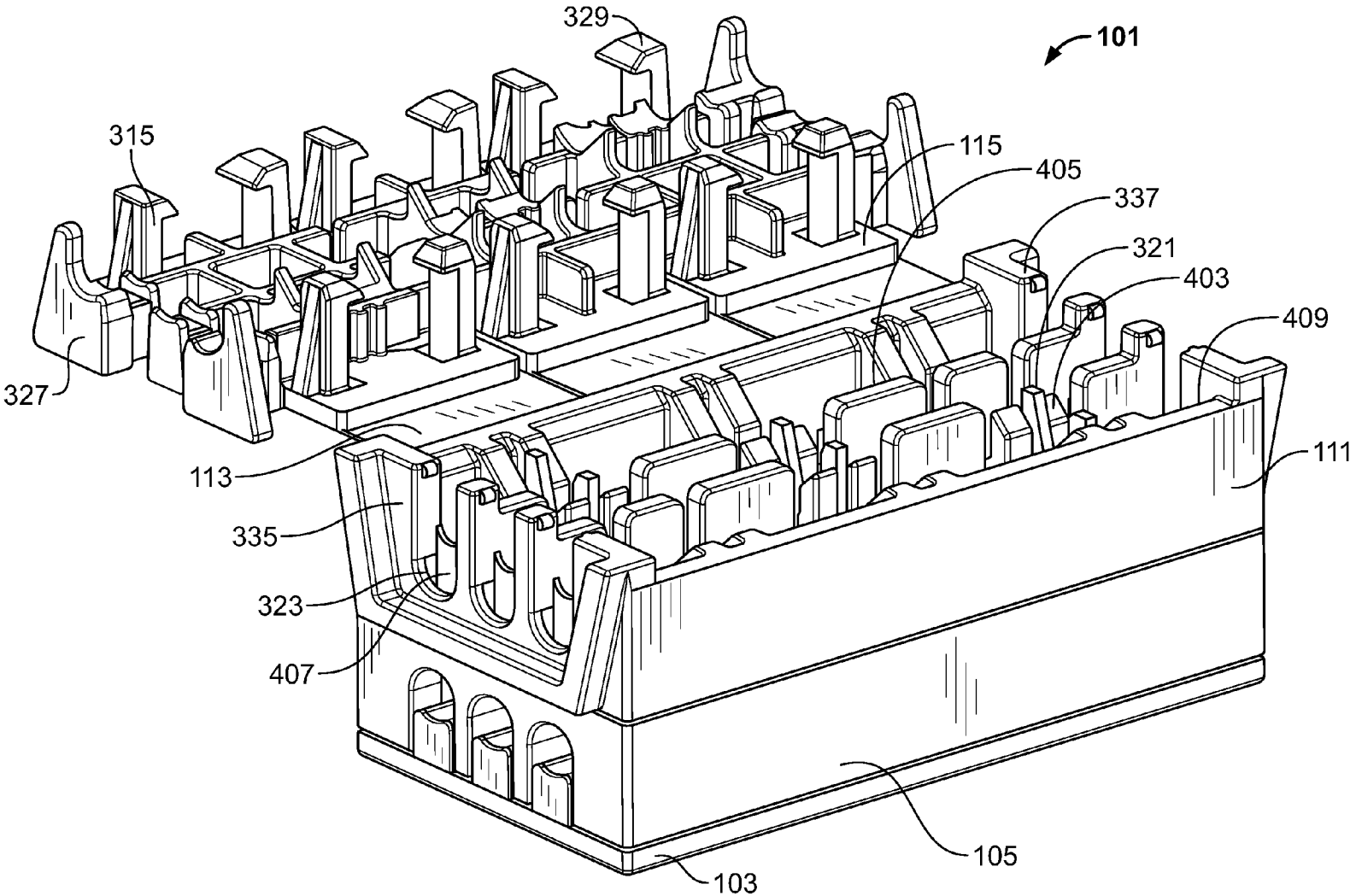
FIG. 4 is a front upper right perspective view of the IDC connector, with the field-wired cover open, in accordance with an embodiment of the present invention.

Field guide walls 405, discussed further with respect to FIG. 4, are located inside the field housing 111. The field guide walls 405 may be parallel to the side walls of the field housing 111. The field guide walls 405 may separate and guide the field-installed wiring to the desired position.

IDC apertures 331 are located on the bottom surface of the field housing 111, and allow the IDC's 321 to pass through the bottom surface of the field housing 111 to make electrical contact with the field wiring.

Field IDC guides 403, discussed further with respect to FIG. 4, may be located inside the field housing 111 over the IDC apertures 331, and may guide the IDC's 321 into position and prevent them from dislocating or bending excessively after they are inserted into IDC apertures 313, 331. The IDC apertures 331 may be staggered to allow the IDC connector 101 to be narrower, and may be aligned with the IDC apertures 313 of the factory housing 105.

A field cover face 327 may be located on one or more sides of one or more field covers 115. The field cover face 327 may secure the field-installed wiring and may also prevent unwanted dust and other particles located in the environment outside the raceway IDC connector 101 from entering the field housing 111.

Latches 329 may be located on each of the field covers 115. The latches 329 may couple the field covers 115 to the field housing 111, discussed further with respect to FIGS. 4 and 5. Alternatively, the field covers 115 may be coupled to the field housing 111 by gluing, a retention clip, or by another coupling method known in the art.

The field housing 111 shown in FIG. 1 has three field covers 115 attached to the field housing 111 by three field hinges 113. The number of field covers 115 may vary, and may depend on the number of wires in the field housing 111, although the number of field covers 115 and the number of wires in the field wiring do not necessary need to be equal. For instance, a single field cover 115 may push down one or more wires onto one or more IDC's 321.

The IDC's 321 may be inserted into the IDC apertures 331 of the factory housing 105. The field housing 111 may be placed on top of the factory housing 105. The opposite ends of the IDC's 321 may inserted into the IDC apertures 313 of the factory housing 105. The factory IDC guides 305 and the field IDC guides 403, discussed further with respect to FIG. 4, may guide the IDC's 321 into position and may prevent them from dislocating or bending excessively after they are inserted into IDC apertures 313, 331. The field housing 111 and the factory housing 105 may be attached by ultra-sonic welding, gluing, a retention clip, or another coupling method known in the art.

The factory wiring may be installed into the factory housing 105 by laying the factory wires along factory guide walls 309. In an end-wiring configuration, the factory end wall 311 may be solid in order to protect the ends of the factory-installed wiring that are exposed after they are cut for installation into factory wire apertures 303 of the factory housing 105. Alternatively, in a through-wiring configuration, the factory end wall 311 may have factory wire apertures 303 through which factory wiring may pass.

The factory housing 105 and the factory cover 103 may be attached by ultra-sonic welding, gluing, a retention clip, or by any other suitable coupling method known in the art. When the factory cover 103 is pushed down onto the factory housing 105 during attachment, the factory cover wire restraints 307 may exert pressure on the wire insulation. The pressure from the factory cover 103 during installation may cause the IDC's 321 to pierce through the insulation of the factory-installed wiring and to make electrical contact with the factory-installed wires.

The raceway IDC connector 101 may be included within a factory terminated device, for example, in the electrical or control box on the device. The field wiring may be installed by a field technician into the field housing 111 when the device that includes the IDC connector 101 is installed in the field.

Figure 5:
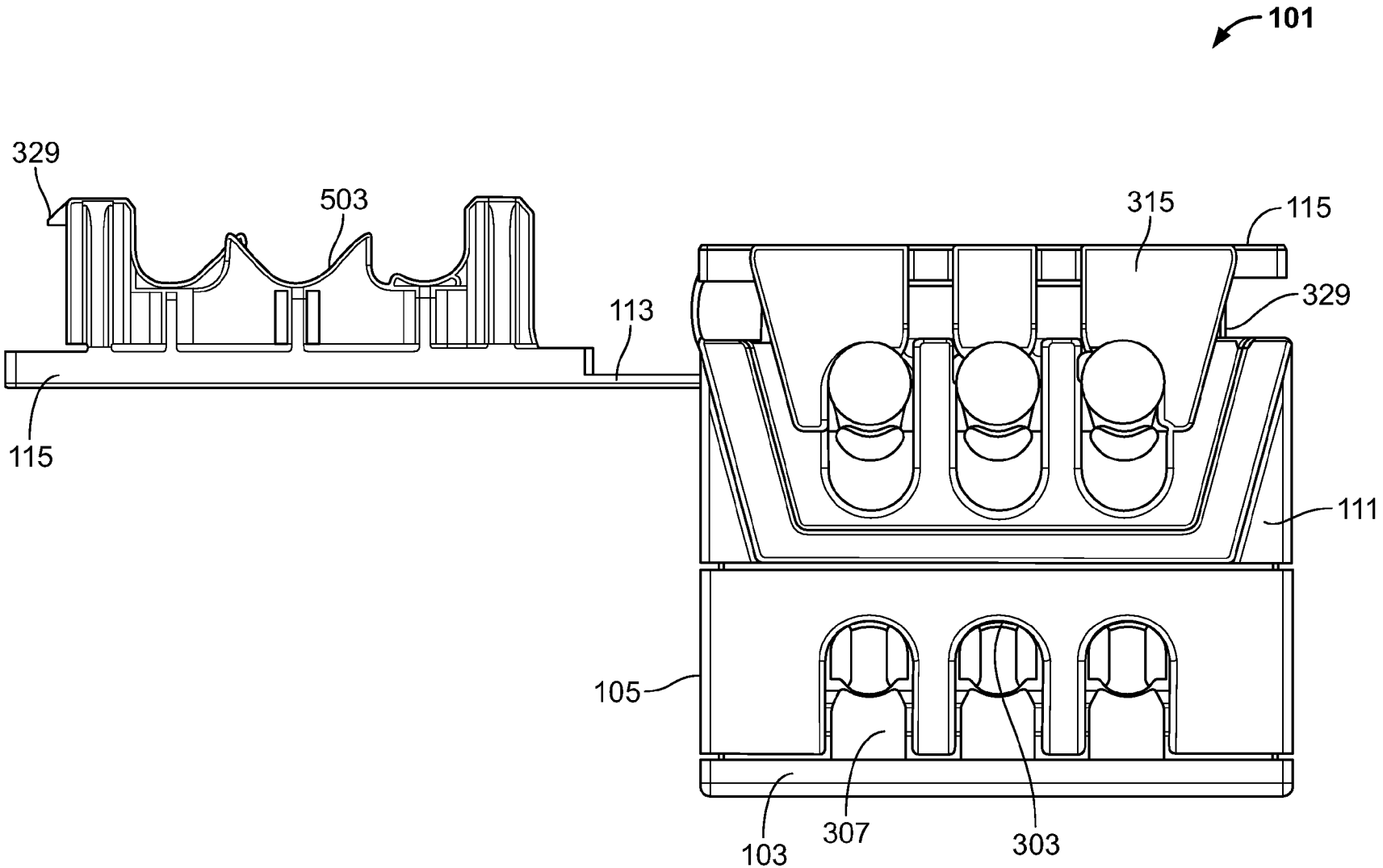
FIG. 5 is a front view of the IDC connector showing one of the field-wired covers in the open position, and another field-wired cover rotated over the field housing before being coupled to the field housing, in accordance with an embodiment of the present invention.

The field wiring may be installed into the field housing 111 by laying the field wires along the field guide walls 405, discussed further with respect to FIGS. 4 and 5. In an embodiment in which the field covers 115 are attached to the field housing 105 with flexible plastic hinges, the field covers 115 may be individually rotated into position over the field housing 111 and pushed down over the field housing 111 to couple the field housing 111 to the field covers 115. When the field covers 115 are pushed down onto the field housing 111, the field cover wire restraints 315, discussed further with respect to FIG. 4, may exert pressure on the wires, causing the IDC's 321 to pierce through the insulation of the field-installed wiring and to make electrical contact with the field-installed wires.

The IDC connector 101 may be sized to fit into standard-sized electrical raceways for convenient field installation.

Figure 2:
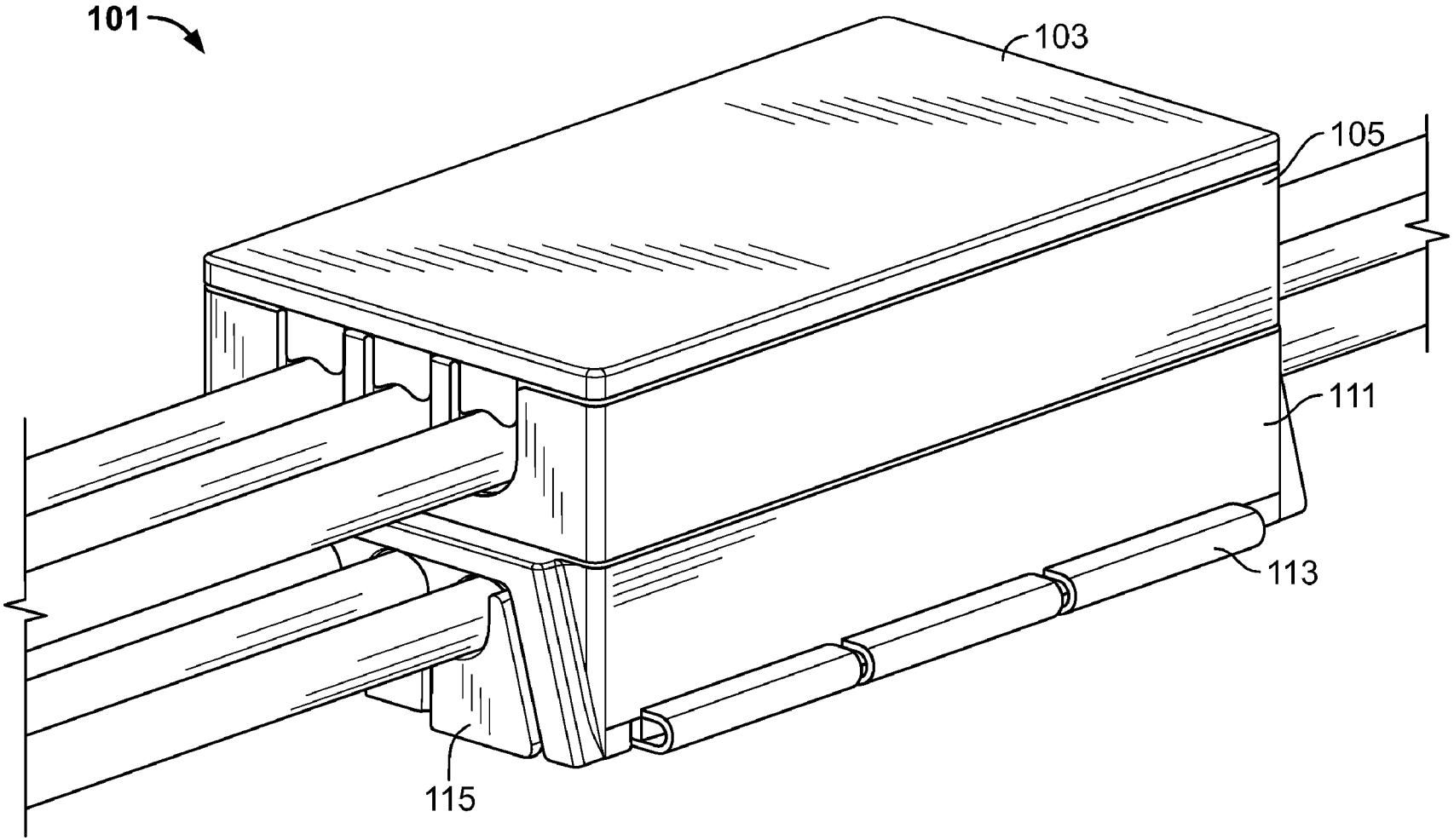
FIG. 2 is a front upper right perspective view of an IDC connector having factory wiring and field through-wiring, in accordance with an embodiment of the present invention.

FIG. 2 is a front upper right perspective view of an IDC connector having factory end-wiring and field through-wiring, in accordance with an embodiment of the present invention. The through-wiring configuration shown in FIG. 2 has factory wiring entering the IDC connector 101 and the coupled field wiring extending from both sides of the IDC connector 101.

The factory housing 105 houses the factory wiring, made up of, for example, three power wires of either 120 VAC or 230 VAC. The factory cover 103 and the factory guide walls 309 may hold the factory wiring in place.

The field covers 115 may be placed over the field housing 111 and coupled to the field housing 111 to secure the field wiring. The through-wiring tab 407, discussed further with respect to FIGS. 4 and 5, may be crushed when the field covers 115 are coupled to the field housing 111. Alternatively, the through-wiring tab 407 may be removed before the field wiring is laid into the IDC connector 101 by the field technician, for example, by pinching the through-wiring tab 407 with pliers and pulling the tab off the IDC connector 101. The through-wiring tabs 407 may have perforations to aid the field technician in removing the through-wiring tabs 407.

Figure 3:
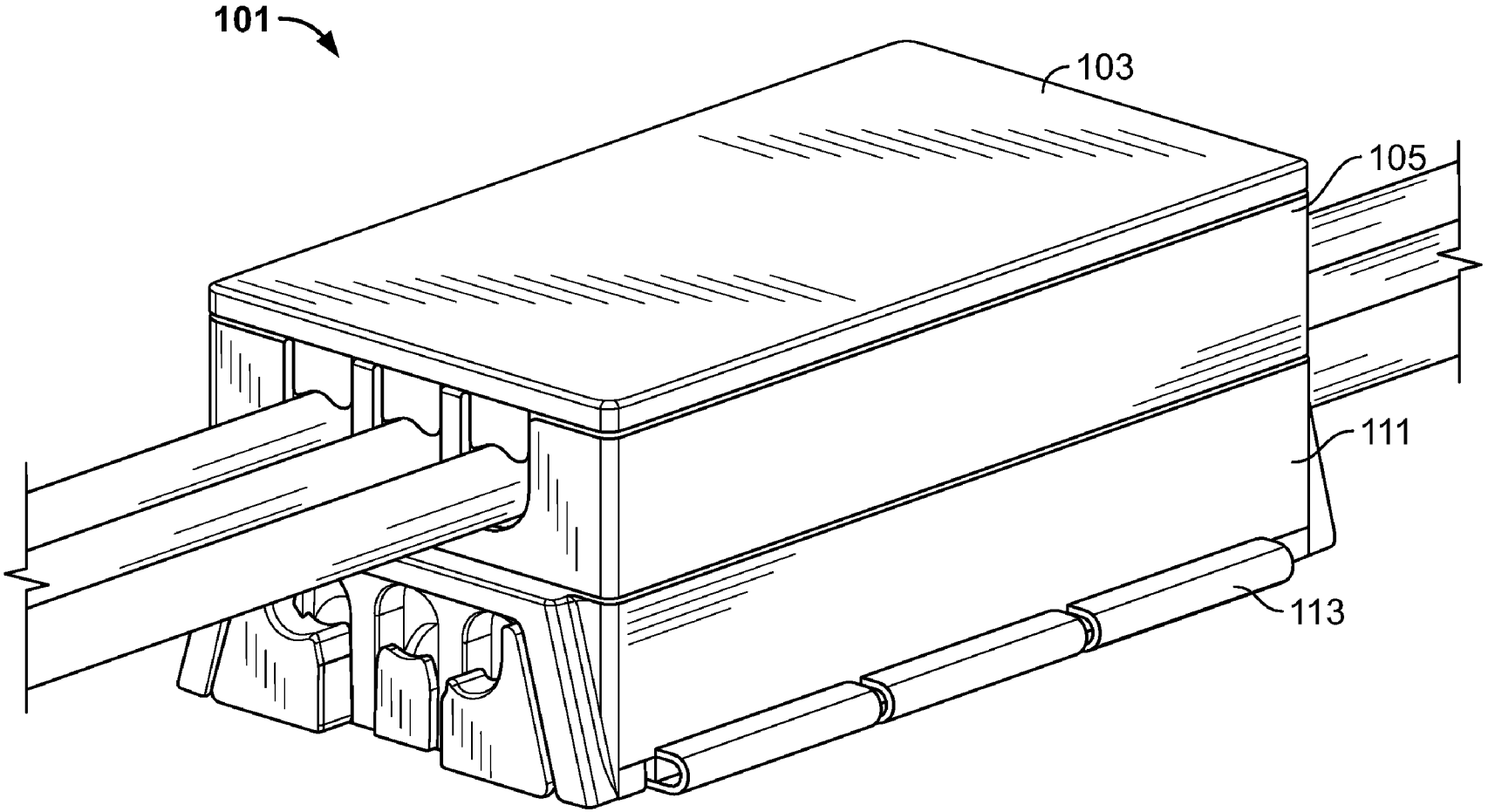
FIG. 3 is a front upper right perspective view of an IDC connector having factory wiring and field end-wiring, in accordance with an embodiment of the present invention.

FIG. 3 shows an end-wiring configuration, whereby the field wiring is terminated inside the field housing 111, and extends from only one side of the IDC connector 101, in accordance with an embodiment of the present invention. The end-wiring configuration may be installed similarly to the through-wiring configuration discussed with respect to FIG. 2, except that the field wiring may be terminated within the field housing 111. The through-wiring tabs 407, discussed further with respect to FIGS. 4 and 5, may remain intact and may protect the field wiring from dust and other particles in the environment of the IDC connector 101.

FIG. 4 is a front upper right perspective view of the IDC connector 101, with the field-wired cover open. The factory wiring is not shown in FIG. 4; however, in a typical installation the factory wiring would extend from the factory wire apertures 303.

Retaining rims 409 are located on the side wall of the field housing 111. Latches 329, shown in further detail in FIG. 5, may couple with the retaining rims 409 to hold the field covers 115 in place, in accordance with an embodiment of the present invention.

The field guide walls 405 are shown in FIG. 1 as being interrupted by the field IDC guides 403. The number and location of the interruptions in the length of the factory guide walls 309 may depend on the number, size, and location of IDC's 321 and the IDC apertures 331.

The through-wiring tabs 407 may be located inside the field wire apertures 323 on the field front wall 335. The through-wiring tabs 407 may preferably be made of a plastic that may be crushed by the pressure of the field Wiring when the field covers 115 are installed over the field housing 111. Alternatively, as discussed with respect to FIG. 4, the through-wiring tabs 407 may be made of a plastic that may be removed by a field technician. For example, the through-wiring tabs 407 may have perforations to aid the field technician to remove the through-wiring tabs 407. The through-wiring tabs 407 may prevent unwanted dust and other particles located in the environment outside the IDC connector 101 from entering the field housing 111 in the end-wiring configuration discussed with respect to FIG. 2.

FIG. 5 is a front view of the IDC connector showing one of the field-wired covers in the open position, and another field-wired cover in the closed position, before being coupled to the field housing 111 by the field technician. The field cover face 327 may be tapered to guide the cover into place after it has been rotated over the field housing 111. Saddle guides 503 may guide the field cover 115 over the wires as it is rotated over the field housing 111.

The front field cover 115 is shown in FIG. 5, positioned over the field housing 111. In order to couple the field cover 115 to the field housing 111, the field technician may push the field cover 115 onto the field housing 111 using channel lock pliers or an equivalent tool. The latch 329 may snap over the retaining rim 409, thereby coupling the field cover 115 with the field housing 111. As discussed with respect to FIGS. 1-3, the field covers 115 may also be coupled in other ways.

Using a plurality of field covers 115 may reduce the physical effort required by the field technician to couple each field cover 115, because the field technician may be piercing through fewer wire insulations each time a field cover 115 is coupled to the field housing 111. Any number of field covers 115 may be used, and the number may be as many as the number of wires contained in the field housing 111.

Figure 6:
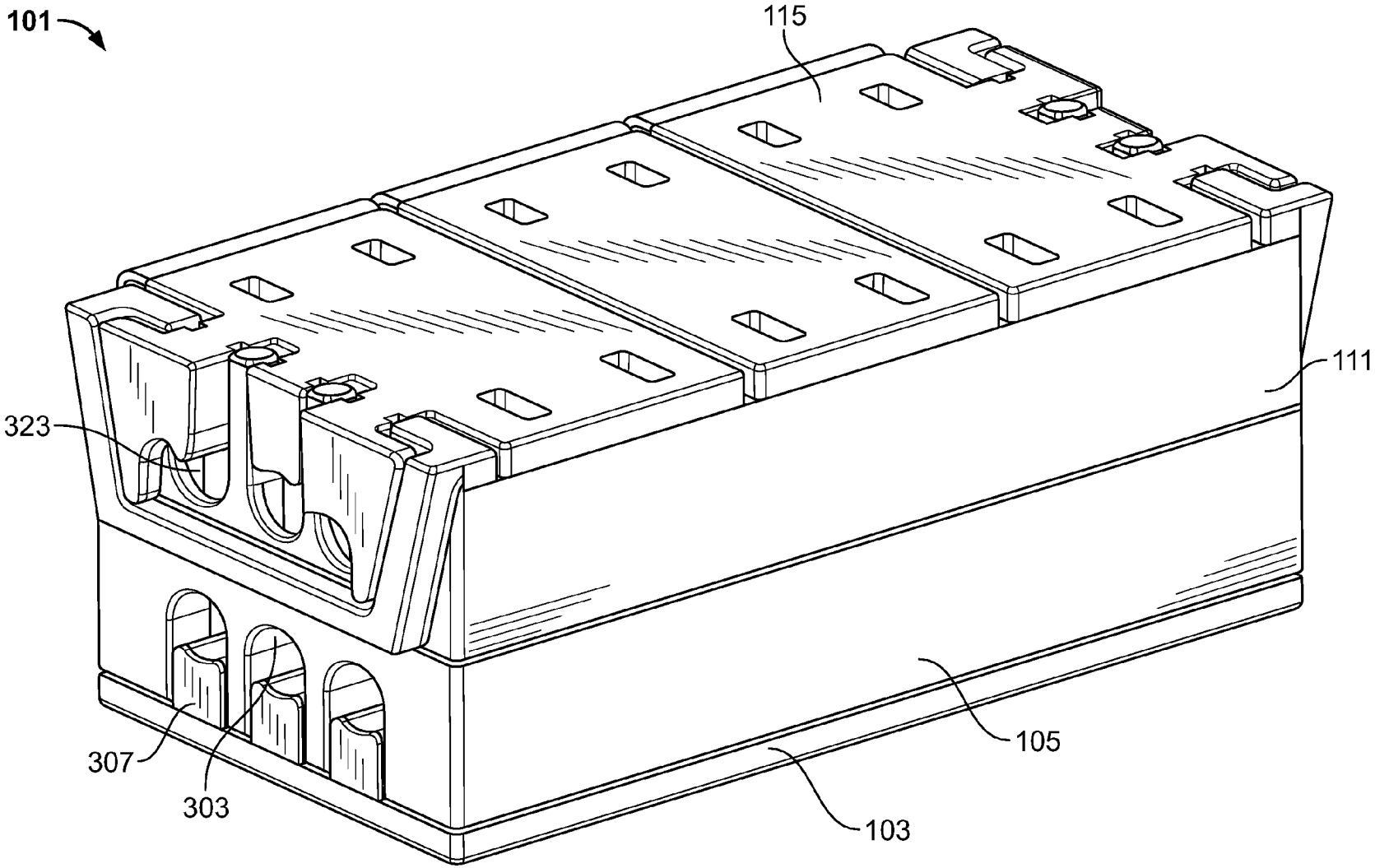
FIG. 6 is a front upper right perspective view of the IDC connector with the field-wired cover closed, in accordance with an embodiment of the present invention.

FIG. 6 is a front upper right perspective view of the IDC connector 101 with the field covers 115 coupled to the field housing 111. In this view, the field covers 115 have all been rotated over the field housing 111 and locked into place by the field technician. Field cover recesses 325 are shown on the field covers 115. Field cover recesses 325 may assist the field technician in coupling the field covers 115 to the field housing 111. The field wiring and the factory wiring are not shown.

Figure 7A:
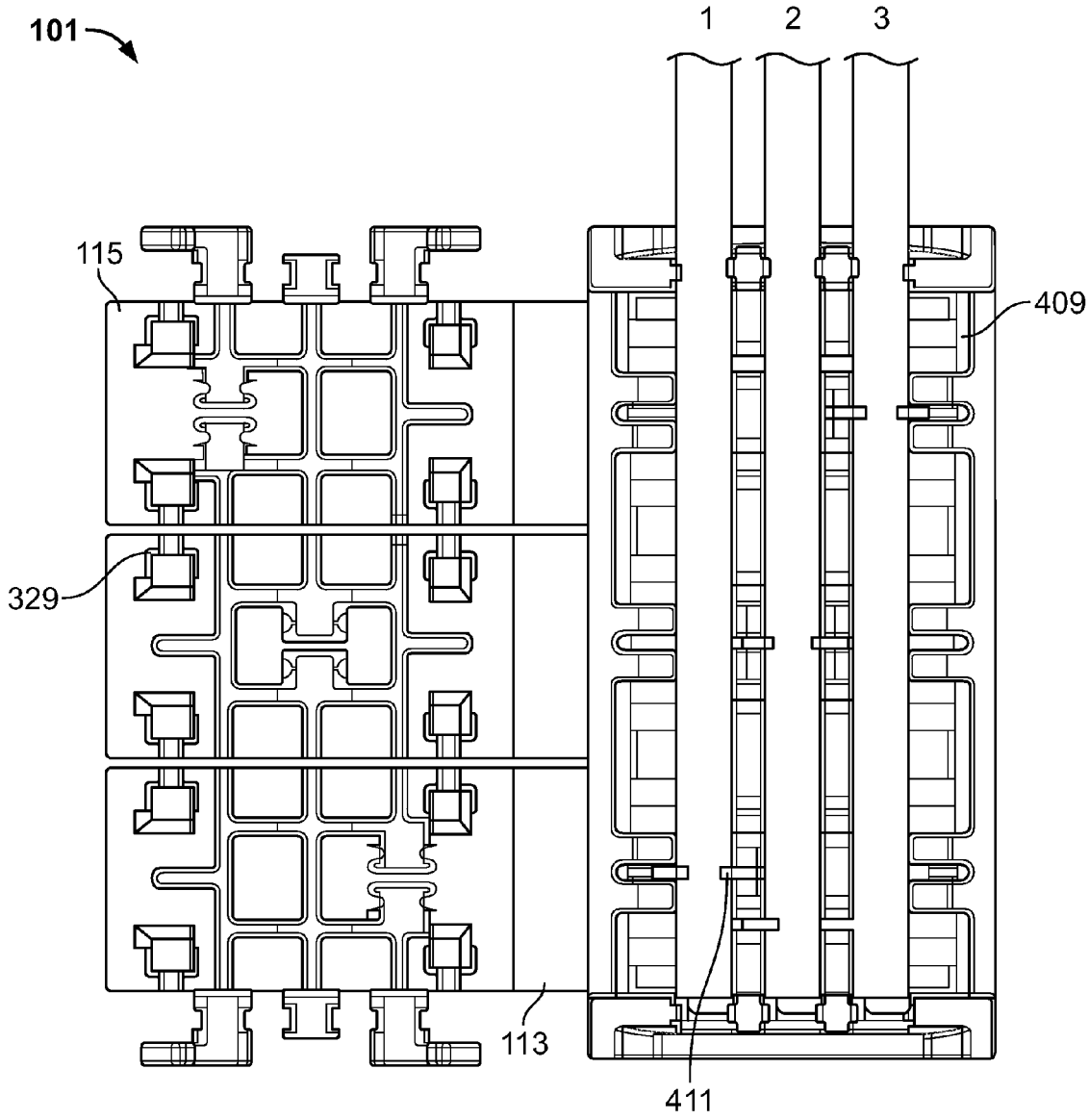
FIG. 7*a* is a top plan view of an IDC connector having field end-wiring with the field covers in the open position, in accordance with an embodiment of the present invention.
Figure 7B:
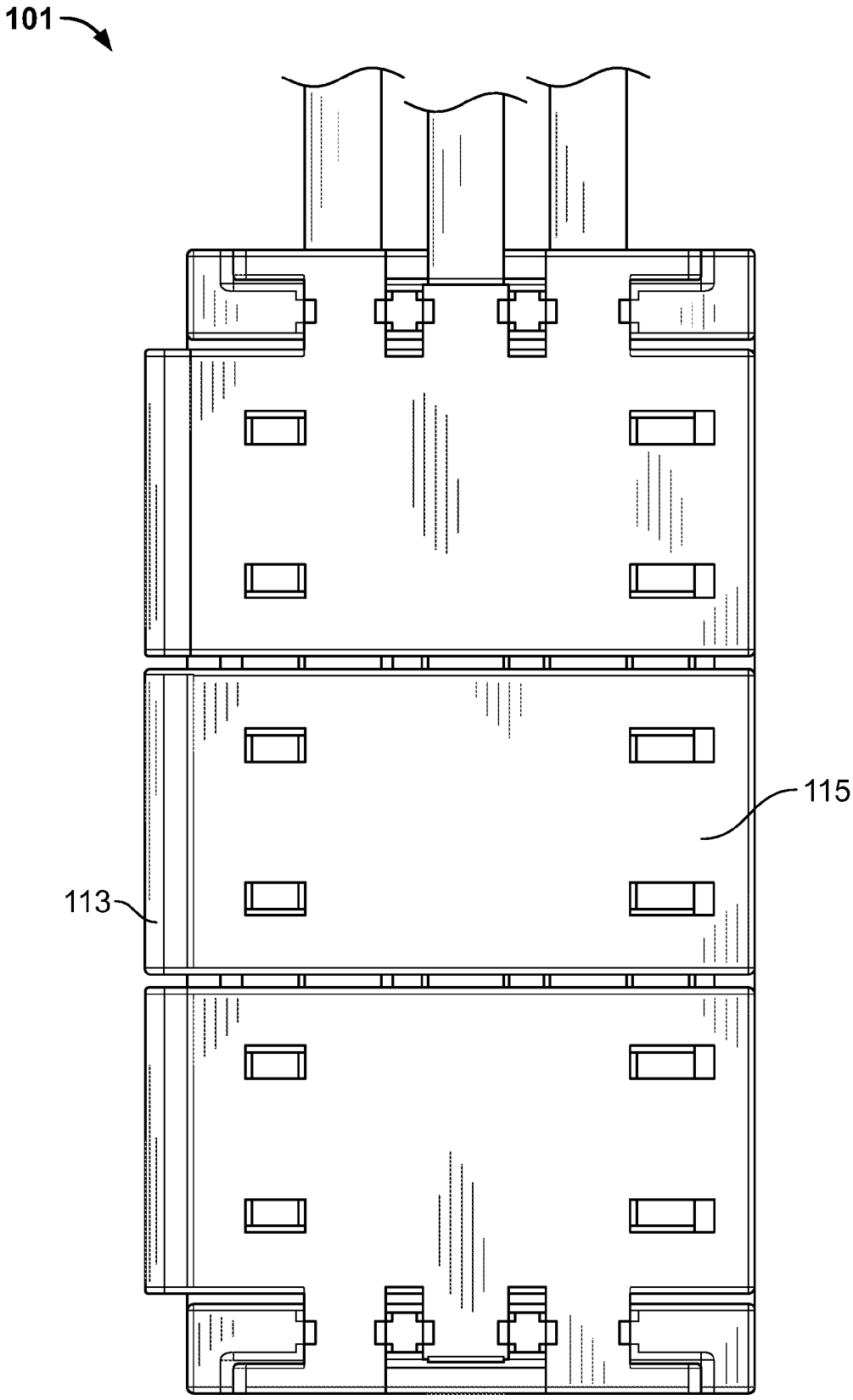
FIG. 7*b* is a top plan view of an IDC connector having field end-wiring with the field covers in the closed position, in accordance with an embodiment of the present invention.

FIG. 7*a* is a top perspective view of an IDC connector 101 having field end-wiring with the field covers in the open position. The field wiring may be cut to fit within the length of the field housing 111. The field wiring may be laid into the field housing 111 and pushed down under the wire retainers 305. The field covers 115 may each be rotated over the field housing 111. The field technician may couple each field cover 115 individually using Channel Lock® pliers or an equivalent tool. FIG. 7*b* shows the IDC connector 101 having field end-wiring with the field covers 115 coupled to the field housing 111.

Figure 8A:
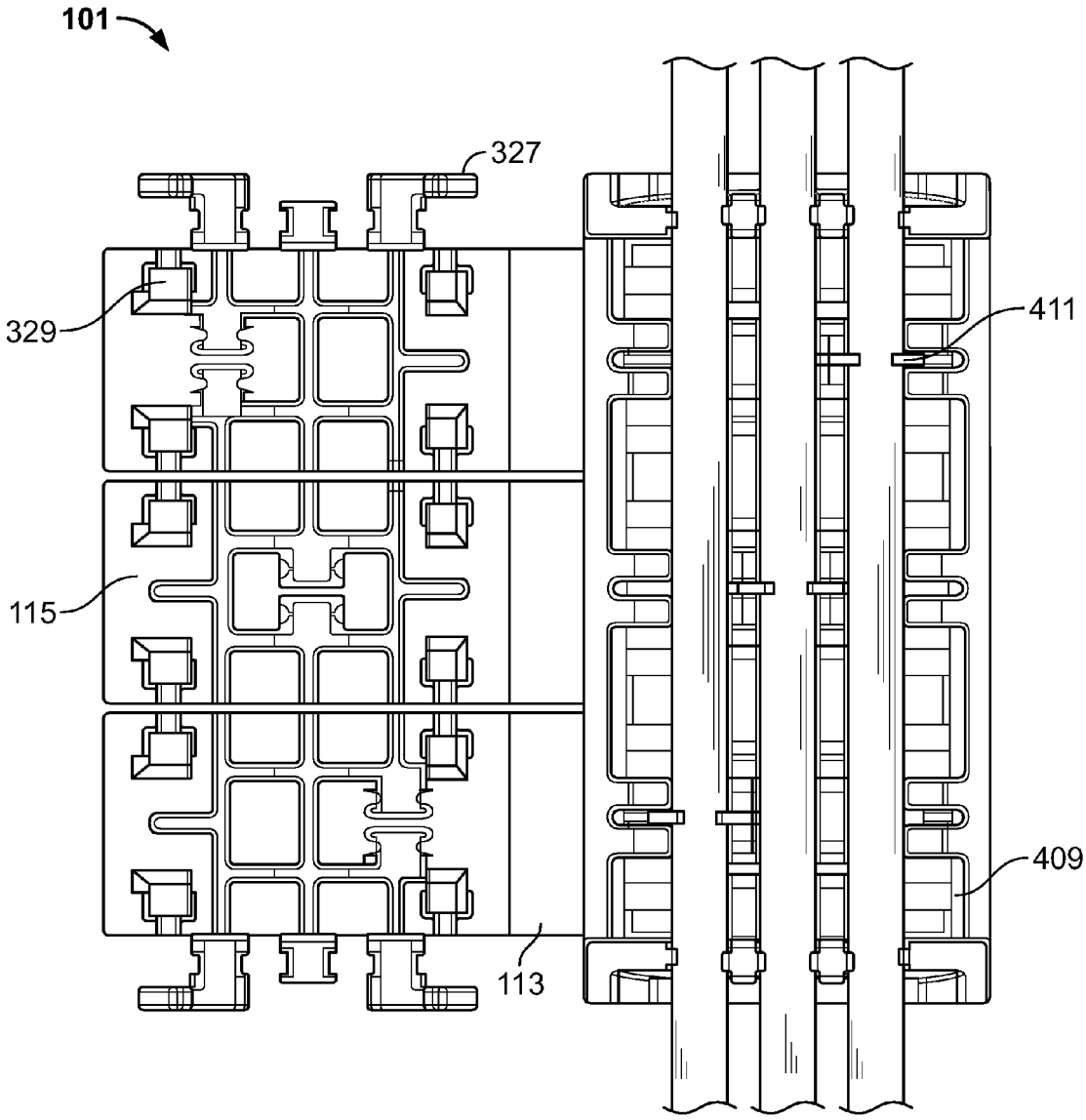
FIG. 8*a* is a top plan view of an IDC connector having field through-wiring with the field covers in the open position, in accordance with an embodiment of the present invention.
Figure 8B:
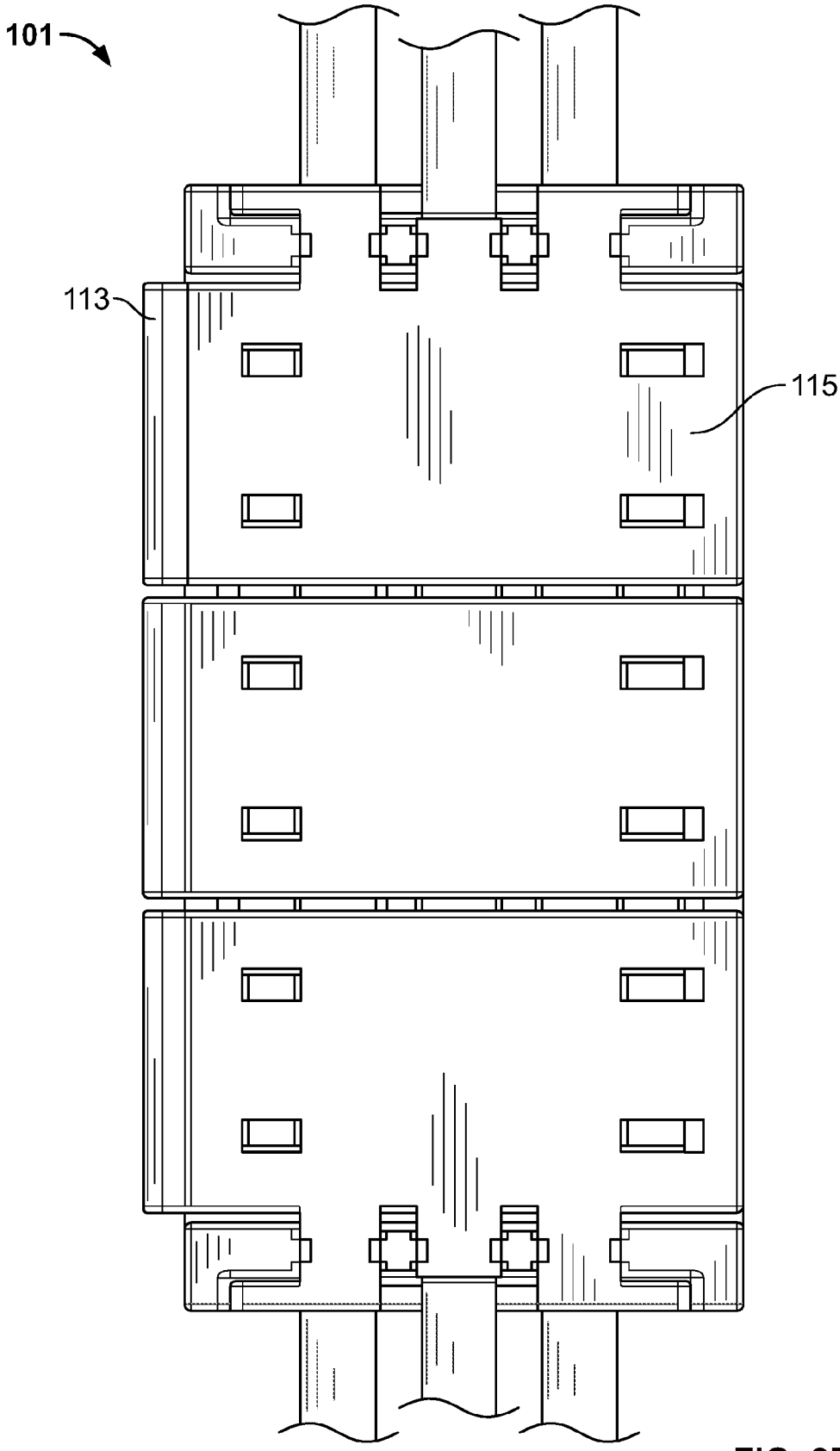
FIG. 8*b* is a top plan view of an IDC connector having field through-wiring with the field covers in the closed position, in accordance with an embodiment of the present invention.

FIG. 8*a* is a top perspective view of an IDC connector 101 having field through-wiring with the field covers in the open position. The field wiring may be laid into the field housing 111 and pushed down under the wire retainers 305. The field wiring may be placed within the field wire apertures 323 on the field back wall 337, and over the through-wiring tab 407. The field covers 115 may each be rotated over the field housing 111. The field technician may couple each field cover 115 individually using Channel Lock® pliers or an equivalent tool. The pressure from the wires may crush the thin wall of the through-wiring tab 407, allowing the field wiring to extend from both ends of the field housing 111. Alternatively, as discussed with respect to FIG. 4, the through-wiring tabs 407 may be removed by the field technician. FIG. 8*b* shows the IDC connector having field through-wiring with the field covers 115 coupled to the field housing 111.

Figure 9:
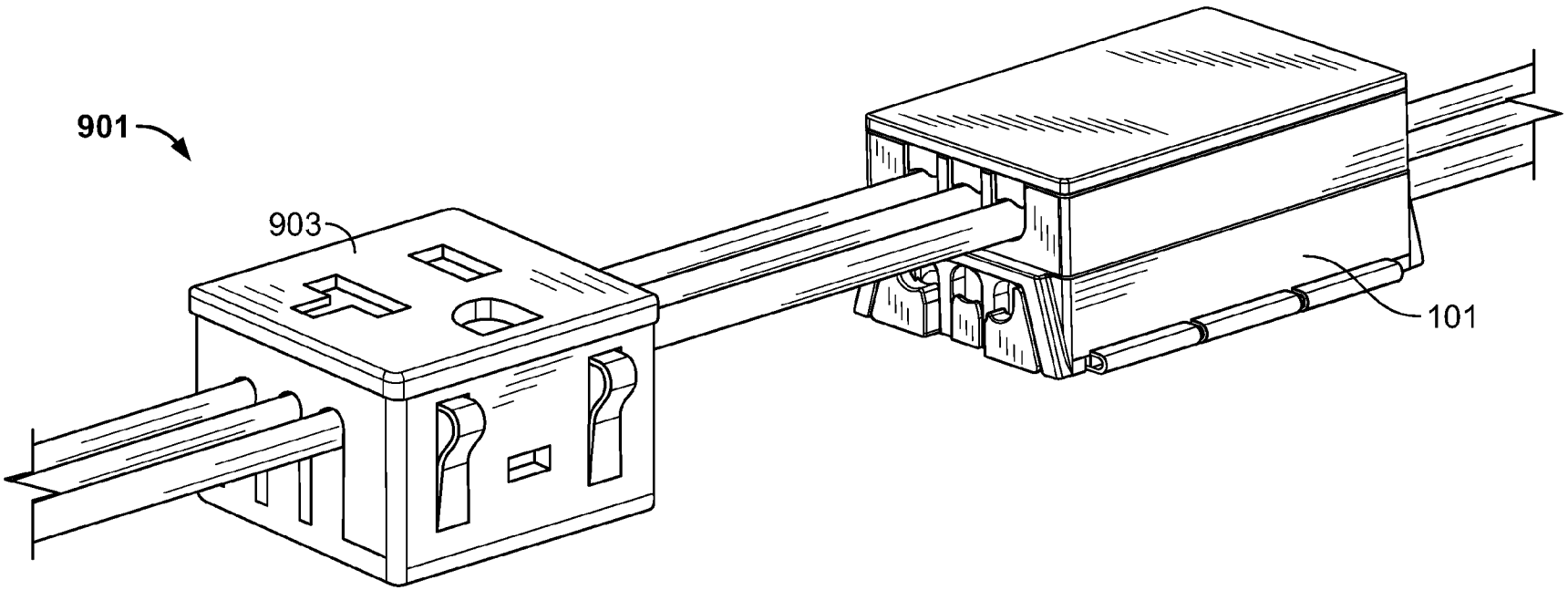
FIG. 9 is an illustration of a typical installation of the IDC connector to an outlet, in accordance with an embodiment of the present invention.
Figure 10:
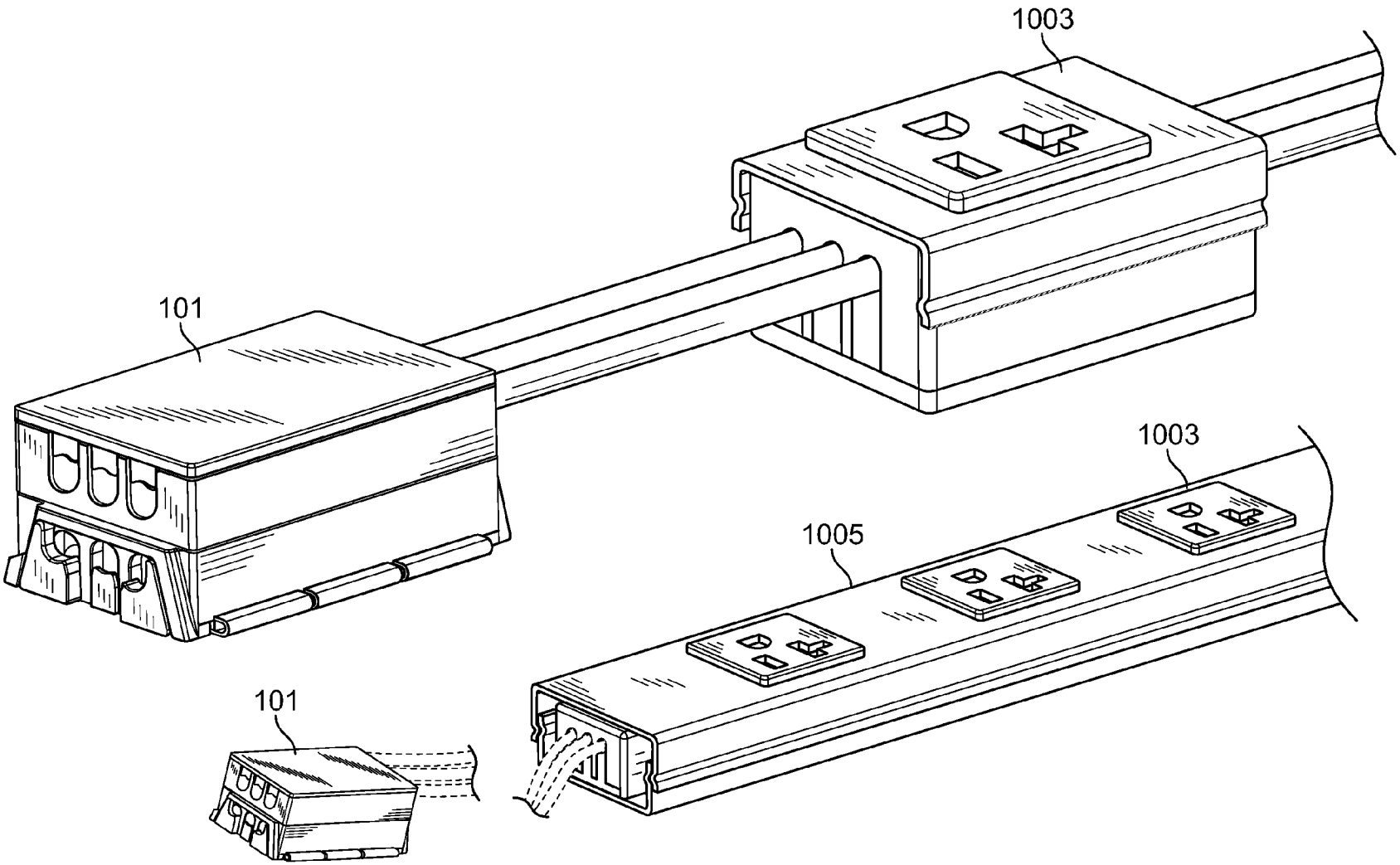
FIG. 10 is an illustration of a typical installation of the IDC connector to a receptacle-type outlet, in accordance with an embodiment of the present invention.

FIG. 9 is an illustration of a typical installation 901 of the IDC connector 101 to an outlet 903. A typical outlet 903 may have factory wiring installed. The IDC connector 101 may be terminated to the factory wiring extending from the outlet 903. The field wiring may be terminated to the IDC connector 101 in an end-wiring configuration as described with respect to FIG. 3. An outlet 903 is shown in FIG. 9; however, any type of electrical receptacle may alternatively be used.

FIG. 10*a* is an illustration of a typical installation of the IDC connector 101 to a receptacle-type outlet 1003. A typical outlet 1005 for installation into an encased outlet strip may have factory wiring and is shown in FIG. 10*a* installed in outlet strip 1005. The IDC connector 101 may be terminated to the factory wiring extending from the outlet 1003. The field wiring may be terminated to the IDC connector 101 in an end-wiring configuration as described with respect to FIG. 3. The IDC connector 101 may be inserted into the outlet strip 1005, as shown in FIG. 10*b*. Alternatively, the IDC connector 101 may be installed into a junction box. An outlet 1003 is shown in FIGS. 10*a* and 10*b*; however, another type of electrical receptacle may be used.

Figure 11:
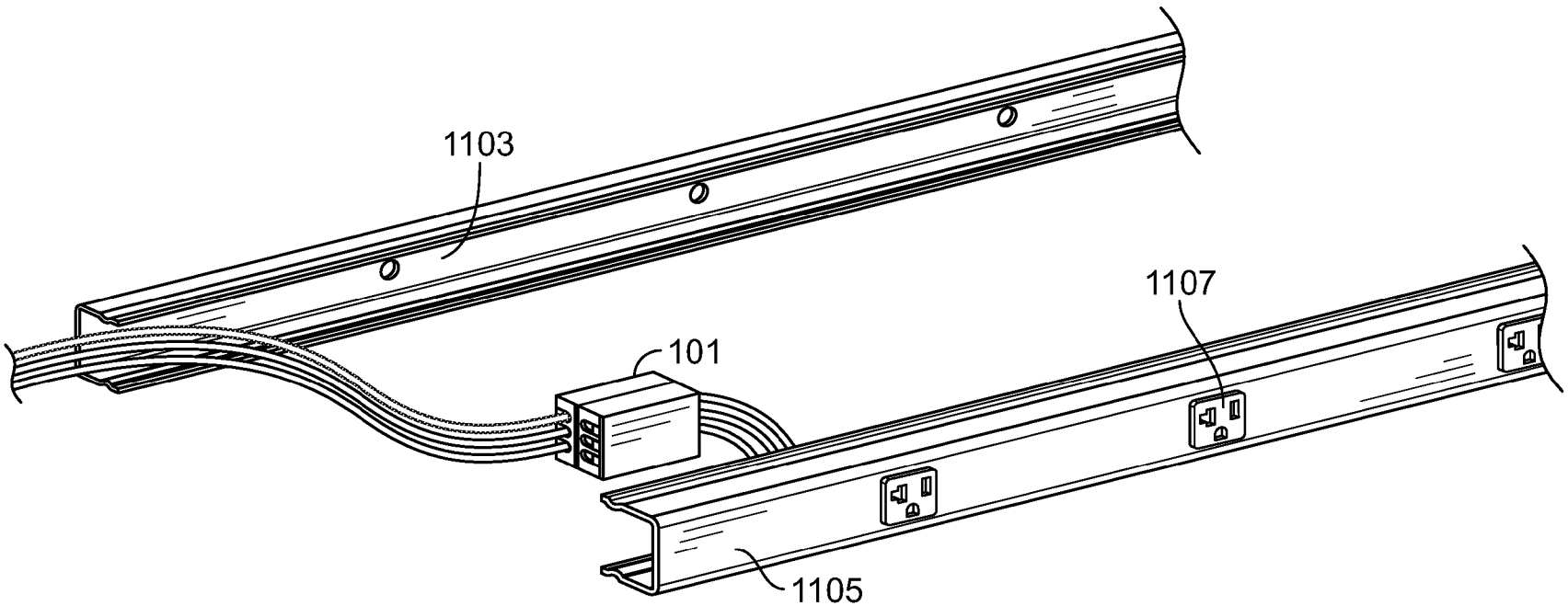
FIG. 11 is an illustration of a typical installation of the IDC connector to an outlet strip base mounted to a wall, in accordance with an embodiment of the invention.

FIG. 11 is an illustration of a typical installation of the IDC connector 101 to an outlet strip base 1103 mounted to a wall. A typical outlet 1107 for installation into an outlet strip base 1103 may have factory wiring and is shown in FIG. 11 installed in outlet strip base 1103. The IDC connector 101 may be terminated to the factory wiring extending from the outlet 1107. The field wiring may be terminated to the IDC connector 101 in an end-wiring configuration, as described with respect to FIG. 3. The IDC connector 101 may be mounted into the outlet strip base 1103. Alternatively, the IDC connector 101 may be installed into a junction box. An outlet 1107 is shown in FIG. 11; however, any type of electrical receptacle may be used. The outlet strip cover 1105 is mounted over the components installed on the outlet strip base 1103.

Figure 12:
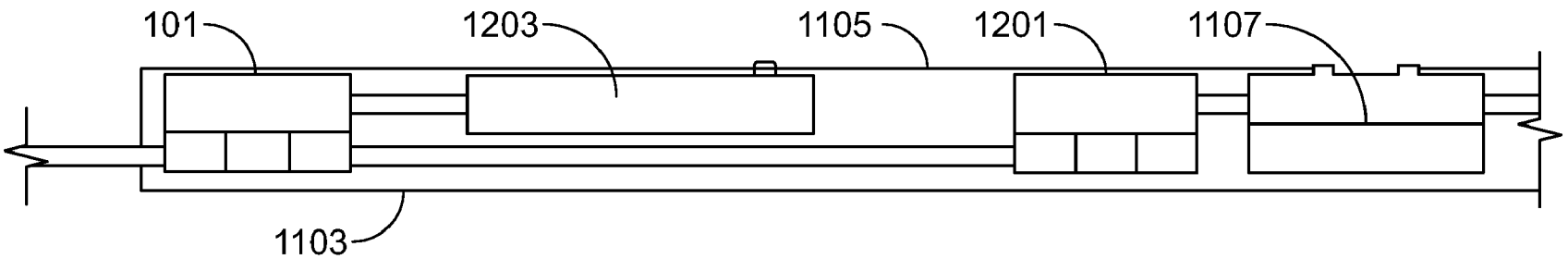
FIG. 12 is an illustration of a typical installation of the IDC connector to a surge suppressor, in accordance with an embodiment of the present invention.

FIG. 12 is an illustration of a typical installation of the IDC connector to a surge suppressor. A typical outlet 1107 for installation into an outlet strip base 1103 may have factory wiring and is shown installed in outlet strip base 1103. A first IDC connector 1201 that may be factory-terminated to an outlet receptacle 1107 and a second IDC connector 101 that may be factory-terminated to a surge suppressor 1203. The first IDC connector 1201 may be field-wired to a second IDC connector 101 in a through-wiring configuration as described with respect to FIG. 2. The first and second IDC connectors 101, 1201 may then be mounted into the outlet strip base 1103. Alternatively, the IDC connectors 101, 1201 may be installed into a junction box. An outlet 1107 is shown in FIG. 12; however, another type of electrical receptacle may be used. The outlet strip cover 1105 may be mounted over the components installed on the outlet strip base 1103.

Figure 13A:
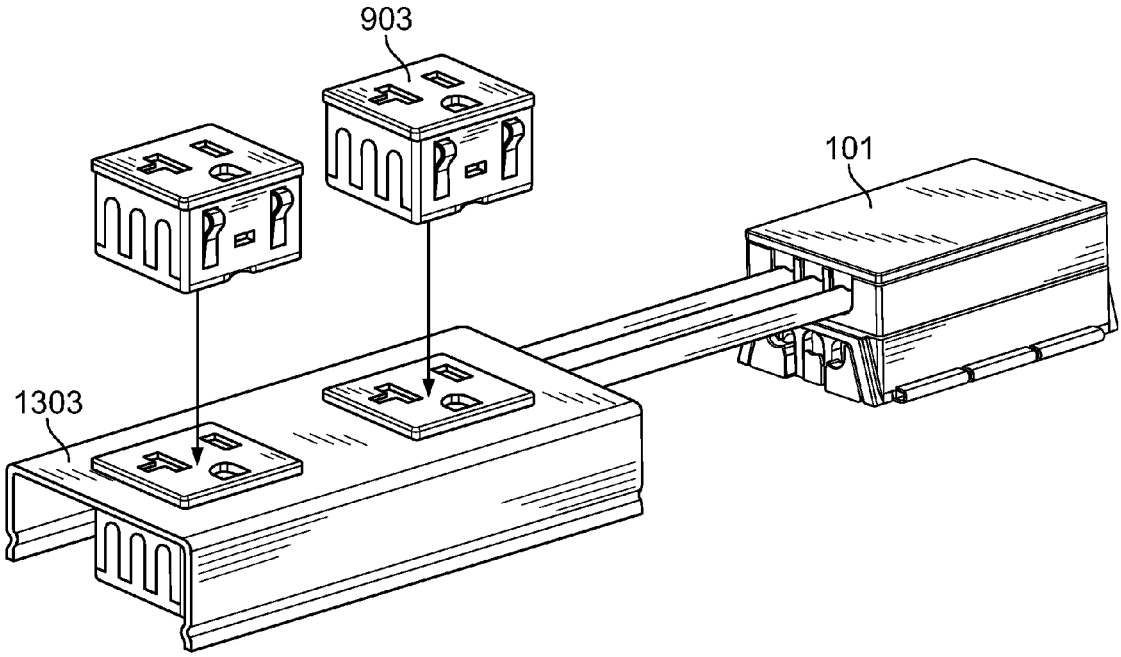
FIG. 13*a* is an illustration of a typical field-wiring of the IDC connector in a raceway with a faceplate, in accordance with an embodiment of the present invention.
Figure 13B:
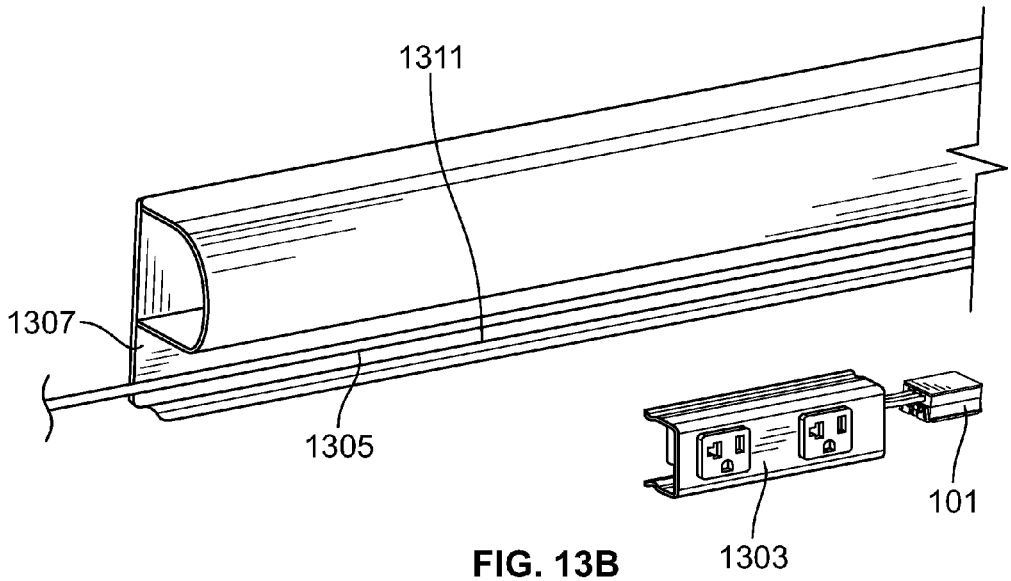
FIG. 13*b* is an illustration of a typical placement of an IDC connector in a raceway with a faceplate, in accordance with an embodiment of the present invention.
Figure 13C:
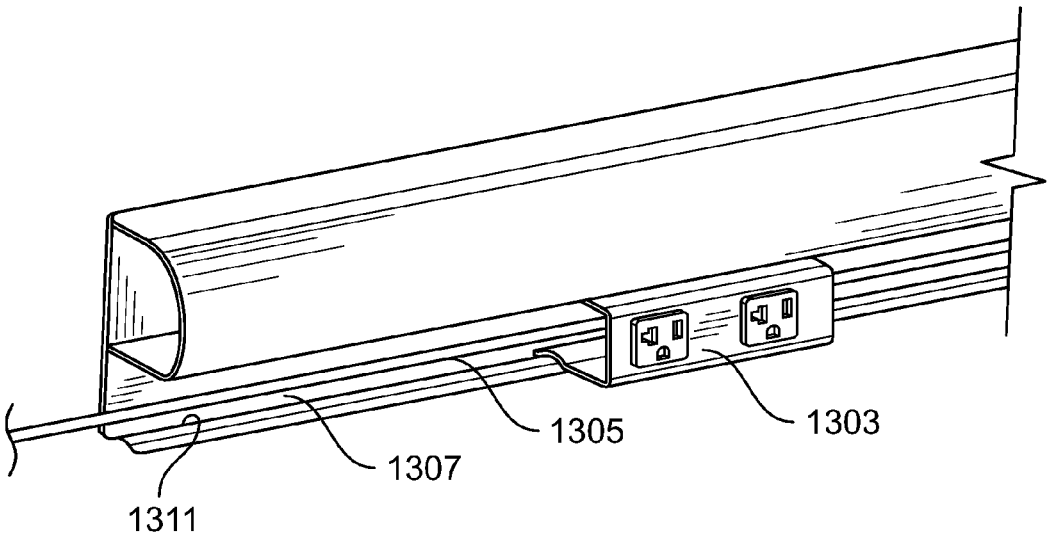
FIG. 13*c* is an illustration of a typical placement of an installed IDC connector into a raceway with a faceplate, in accordance with an embodiment of the present invention.
Figure 13D:
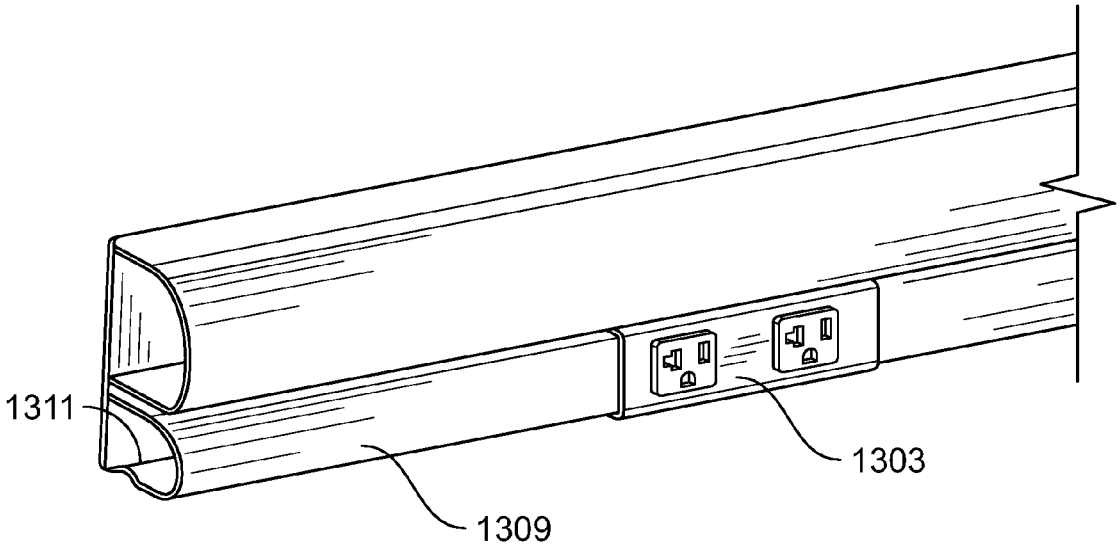
FIG. 13*d* is an illustration of a typical installation of the faceplate over an IDC connector in a raceway, in accordance with an embodiment of the present invention.

FIGS. 13*a-d* illustrate a typical field-wiring of the IDC connector 101 in a raceway 1311 with a faceplate 1303. An IDC connector 101 may be factory-wired to an outlet receptacle 903 with a faceplate 1303. Power wiring 1305 may be field-installed into the power channel 1307 of a raceway 1311. As shown in FIG. 13*b*, the IDC connector 101 may be field-installed onto the power wiring 1305 in a through-wiring configuration as described with respect to FIG. 2. As shown in FIG. 13*c*, the assembly of the outlet receptacle 903 and the faceplate 1303 may be mounted onto the power channel 1307. As shown in FIG. 13*d*, the power channel cover 1309 may be installed over the power channel 1307 to hide and protect the wiring.

It should be understood that the illustrated embodiments are examples only and should not be taken as limiting the scope of the present invention. The claims should not be read as limited to the described order or elements unless stated to that effect. Therefore, all embodiments that come within the scope and spirit of the following claims and equivalents are claimed as the invention.

The invention claimed is:

1. An insulation displacement contact connector, comprising:

a first housing having a plurality of areas for receiving a plurality of wires, a cover for covering an open area of the first housing, a second housing having a plurality of areas for receiving a second plurality of wires, at least one cover for covering at least one open area of the second housing, a plurality of insulation displacement contacts located between the first and second housing, wherein a portion of each insulation displacement contact protrudes into each of the first and second housings, wherein the first housing is coupled to the second housing, wherein the number of areas for receiving the first plurality of wires is equal to the number of areas for receiving the second plurality of wires, wherein the first housing comprises at least one factory-installed wire, and wherein the size of the first and second housings are chosen so that the insulation displacement contact connector is securely retained when inserted into a standard electrical raceway.

2. The insulation displacement contact connector of claim 1, wherein the insulation displacement contacts are staggered.

3. The insulation displacement contact connector of claim 1, wherein a first side of the first housing has apertures for receiving a plurality of wires, wherein a second side wall of the first housing is solid, and wherein the first side of the first housing is opposite the second side of the first housing.

4. The insulation displacement contact connector of claim 1, wherein the at least one cover for covering an open area of the second housing is coupled to the second housing by at least one retaining clip.

5. The insulation displacement contact connector of claim 1, wherein the cover for covering an open area of the first housing is coupled to the first housing by ultrasonic welding.

6. The insulation displacement contact connector of claim 1, wherein the cover for covering an open area of the first housing is coupled to the first housing by an adhesive.

7. The insulation displacement contact connector of claim 1, further comprising a plurality of covers for covering at least one open area of the second housing.

8. The insulation displacement contact connector of claim 7, wherein the plurality of covers for covering at least one open area of the second housing are attached to the second housing by a flexible plastic hinge.

9. The insulation displacement contact connector of claim 1, wherein a portion of the at least one cover for covering an open area of the second housing asserts a downward force on a wire when the at least one cover for covering an open area of the second housing is coupled to the second housing, and wherein the downward force causes the insulation displacement contact to pierce an insulation of the wire and make electrical contact with a conductor of the wire.

10. The insulation displacement contact connector of claim 9, wherein the at least one cover for covering an open area of the second housing comprises a plurality of covers, and wherein the number of covers is equal to the number of areas for receiving wires.

11. The insulation displacement contact connector of claim 1, further comprising:

tabs located in apertures located on a second side of the second housing, wherein the tabs at least partially close at least one of the apertures located on the second side of the second housing, wherein a first side of the second housing has apertures for receiving the second plurality of wires, wherein the second side of the second housing has apertures for receiving the second plurality of wires, and wherein the first side of the second housing is opposite the second side of the second housing.

12. The insulation displacement contact connector of claim 11, wherein the tabs are composed of plastic, and wherein the tabs are crushed by the plurality of wires located in the apertures located on a second side of the second housing when the at least one cover of the second housing is coupled to the second housing.

13. The insulation displacement contact connector of claim 11, wherein the tabs are composed of plastic, and wherein the tabs are perforated to reduce the effort required from the field technician to remove the tabs.

14. A method for connecting a plurality of wires, comprising:

laying a plurality of wires in a first housing having a plurality of areas for receiving a first plurality of wires, wherein laying a plurality of wires in the first housing comprises laying the plurality of wires in a factory, placing a plurality of insulation displacement contacts between the first housing and a second housing, wherein a portion of each insulation displacement contact protrudes into each of the first and second housings, coupling the first housing to a second housing, wherein the second housing has a plurality of areas for receiving a second plurality of wires, and wherein the number of areas for receiving the first plurality of wires is equal to the number of areas for receiving the second plurality of wires, and coupling a cover for covering an open area of the first housing to the first housing to cause the plurality of insulation displacement contacts to pierce the insulation of the first plurality of wires and to make electrical contact with conductors of the first plurality of wires, selecting the size of the first and second housings so that the insulation displacement contact connector is securely retained when inserted into a standard electrical raceway.

15. The method of claim 14, wherein the insulation displacement contacts are staggered in relation to a side of the first or second housings.

16. The method of claim 14, further comprising:

laying the second plurality of wires into the plurality of areas for receiving the second plurality of wires, wherein a field technician lays the second plurality of wires, coupling at least one cover for covering an open area of the second housing to the second housing, wherein coupling the at least one cover causes the plurality of insulation displacement contacts to pierce the insulation of the second plurality of wires and to make electrical contact with conductors of the second plurality of wires, and wherein the at least one cover for covering an open area of the second housing is coupled to the second housing with a retention clip.

17. The method of claim 16, further comprising crushing tabs located in apertures located on a second side of the second housing with the plurality of wires by applying pressure to the at least one cover of the second housing, wherein the tabs at least partially cover the apertures.

18. The method of claim 14, wherein the at least one cover for covering an open area of the second housing to the second housing comprises a plurality of covers, and wherein the number of covers is equal to the number of the second plurality of wires.

19. The method of claim 18, wherein the plurality of covers are coupled to the second housing by a field technician.

20. An insulation displacement contact connector, comprising:

a first housing having a plurality of areas for receiving a first plurality of wires, wherein the first housing comprises at least one factory-installed wire, a cover for covering an open area of the first housing, a second housing having a plurality of areas for receiving a second plurality of wires, at least one cover for covering at least one open area of the second housing, wherein the at least one cover for covering an open area of the second housing comprises a plurality of covers, wherein the number of covers is equal to the number of areas for receiving the second plurality of wires, and wherein the at least one cover for covering an open area of the second housing is coupled to the second housing by at least one retaining clip, a plurality of insulation displacement contacts located between the first and second housing, wherein a portion of each insulation displacement contact protrudes into each of the first and second housings, a plurality of tabs located in a plurality of apertures for receiving the second plurality of wires, wherein the tabs are composed of plastic, wherein a thickness of the tabs is chosen so that the tabs may be crushed by the second plurality of wires located in the apertures located on a second side of the second housing when the at least one cover of the second housing is coupled to the second housing, a plurality of covers for covering at least one open area of the second housing, wherein the plurality of covers for covering at least one open area of the second housing are attached to the second housing by a flexible plastic hinge, wherein the first housing is coupled to the second housing, wherein the number of areas for receiving the first plurality of wires is equal to the number of areas for receiving the second plurality of wires, wherein the size of the first and second housings are chosen so that the insulation displacement contact connector is securely retained when inserted into a standard electrical raceway, and wherein the insulation displacement contacts are staggered in relation to a side of the first or second housings not having apertures, and wherein the tabs are composed of plastic, wherein tabs are crushed by the first plurality of wires located in the apertures located on a second side of the second housing when the at least one cover of the second housing is coupled to the second housing.

* * * * *

UNITED STATES PATENT AND TRADEMARK OFFICE

CERTIFICATE OF CORRECTION

PATENT NO. : 7,530,827 B2
APPLICATION NO. : 12/124669
DATED : May 12, 2009
INVENTOR(S) : Jack E. Caveney et al.

It is certified that error appears in the above-identified patent and that said Letters Patent is hereby corrected as shown below:

Title page, item [73] the Assignee "Penduit Corp." should read "Panduit Corp."

Signed and Sealed this

Fifteenth Day of September, 2009

David J. Kappos

David J. Kappos
*Director of the United States Patent and Trademark Office*